United States Patent [19]

Shanton

[11] 4,387,117

[45] Jun. 7, 1983

[54] RECORD MATERIAL CARRYING A COLOR DEVELOPER COMPOSITION

[75] Inventor: Kenneth J. Shanton, Beaconsfield, England

[73] Assignee: The Wiggins Teape Group Limited, England

[21] Appl. No.: 272,733

[22] Filed: Jun. 11, 1981

[30] Foreign Application Priority Data

Jun. 12, 1980 [GB] United Kingdom ..... 8019284

[51] Int. Cl.[3] ..... B41M 5/16; B41M 5/18; B41M 5/22

[52] U.S. Cl. ..... 427/150; 282/27.5; 427/151; 427/201; 427/288; 428/329; 428/331; 428/341; 428/342; 428/913; 428/914

[58] Field of Search ..... 282/27.5; 427/150, 151, 427/180, 201, 288, 372.2, 383.5, 387, 391, 395; 428/340, 341, 329, 331, 320.4, 320.6, 320.8, 913, 914, 342, 446, 452, 537

[56] References Cited

U.S. PATENT DOCUMENTS

| | | | |
|---|---|---|---|
| 3,736,285 | 5/1973 | Miller | 260/29.6 |
| 4,289,806 | 9/1981 | Sato et al. | 427/150 |

FOREIGN PATENT DOCUMENTS

| | | | |
|---|---|---|---|
| 44-2193 | 1/1969 | Japan | 282/27.5 |
| 1271304 | 4/1972 | United Kingdom | 282/27.5 |
| 1467003 | 3/1977 | United Kingdom | 282/27.5 |

*Primary Examiner*—Bruce H. Hess

*Attorney, Agent, or Firm*—Burns, Doane, Swecker & Mathis

[57] ABSTRACT

A color developer for use in a pressure- or heat-sensitive record material comprises a particulate amorphous hydrated silica/hydrated alumina composite in which the hydrated silica and hydrated alumina are chemically bound and in which the mean alumina content on a dried weight basis is up to 7.5%, based on the total weight of silica and alumina. The composite may be metal-modified, e.g. with copper.

10 Claims, 2 Drawing Figures

RECORD MATERIAL CARRYING A COLOR DEVELOPER COMPOSITION

Figure 1:
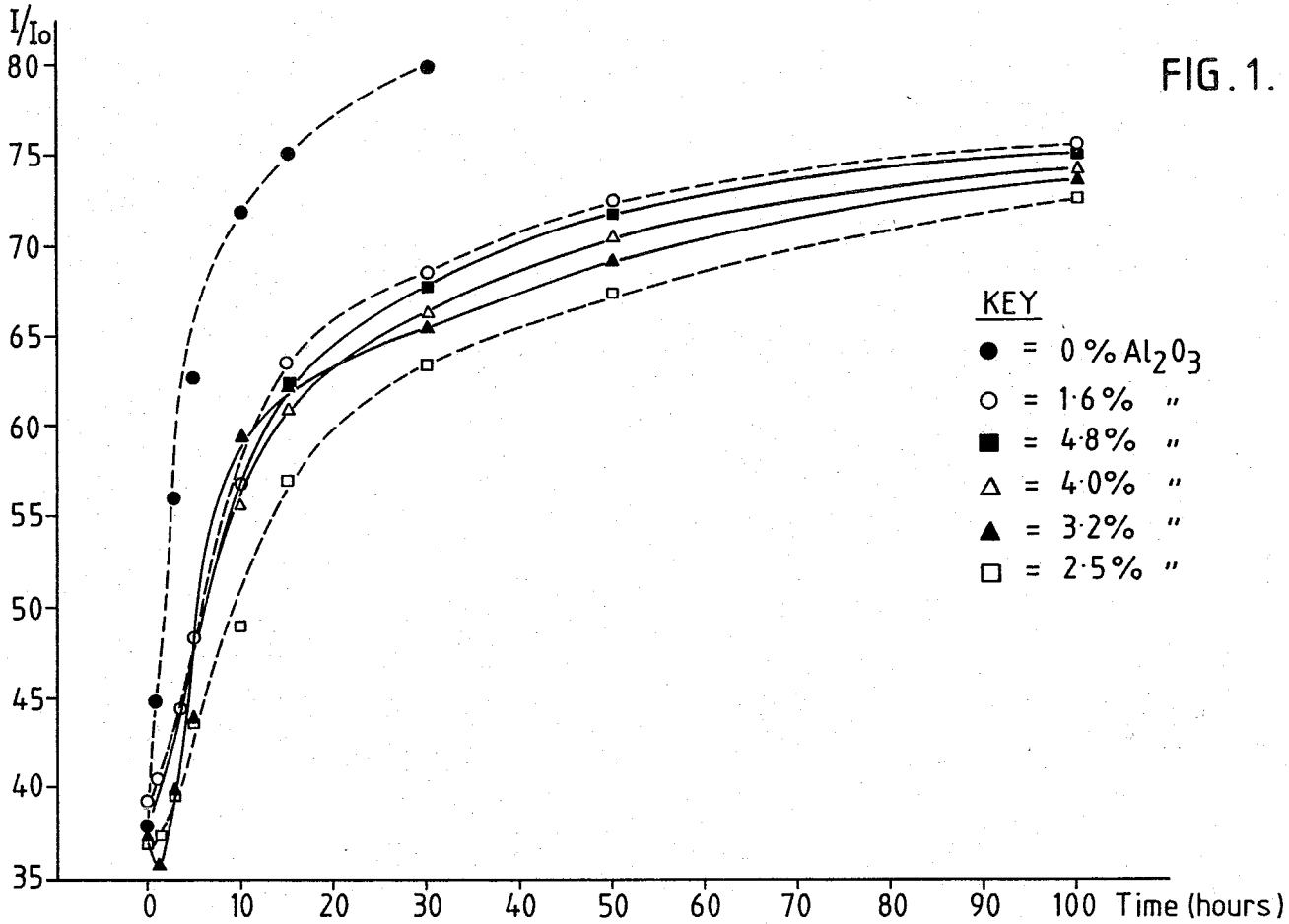

This invention relates to record material carrying a colour developer composition and to a process for the production of the record material. The record material may be, for example, part of a pressure-sensitive copying system or of a heat-sensitive recording system.

In one known type of pressure-sensitive copying system, usually known as a transfer system, an upper sheet is coated on its lower surface with microcapsules containing a solution of one or more colourless colour formers and a lower sheet is coated on its upper surface with a colour developing co-reactant material. A number of intermediate sheets may also be provided, each of which is coated on its lower surface with microcapsules and on its upper surface with colour developing material. Pressure exerted on the sheets by writing or typing ruptures the microcapsules, thereby releasing the colour former solution on to the colour developing material on the next lower sheet and giving rise to a chemical reaction which develops the colour of the colour former. In a variant of this system, the microcapsules are replaced by a coating in which the colour former solution is present as globules in a continuous matrix of solid material.

In another type of pressure-sensitive copying system, usually known as a self-containined or autogeneous system, microcapsules and colour developing co-reactant material are coated onto the same surface of a sheet, and writing or typing on a sheet placed above the thus-coated sheet causes the microcapsules to rupture and release the colour former, which then reacts with the colour developing material on the sheet to produce a colour.

Heat-sensitive recording systems frequently utilise the same type of reactants as those described above to produce a coloured mark, but rely on heat to convert on or both reactants from a solid state in which no reaction occurs to a liquid state which facilitates the colour-forming reaction.

The sheet material used in such systems is usually of paper, although in principle there is no limitation on the type of sheet which may be used.

Siliceous materials, of both natural and synthetic origin, have long been recognised as materials suitable as co-reactants for developing the colour of colour formers for use in record material.

Colour developing siliceous materials of natural origin include attapulgite, kaolin, bentonite and zeolite clays. Colour developing siliceous materials of synthetic origin include hydrate silicas, such as silica gel, and metal silicates, such as magnesium silicate.

U.S. Pat. No. Re. 23,024, and U.S. Pat. Nos. 2,505,488, 2,699,432 2,828,341, 2,828,342, 2,982,547, 3,540,909, and 3,540,910 are examples of disclosures of the silicones materials just discussed. More recently, the use of certain narrowly-specified silica-based co-reactant materials containing a proportion of alumina (7.5 to 28% on a dried weight basis based on the total weight of silica and alumina) has been proposed, see U.K. Patent No. 1 467 003. The use as a co-reactant material of high surface area silica carrying a precipitated metal aluminate on its surface has also been proposed, see U.K. Pat. No. 1 271 304. In the last-mentioned patent, there is only one Example explicitly disclosing a silica/precipitated aluminate co-reactant and in this, the amount of aluminate used corresponds to an alumina content of about 17% on a dried weight bases, based on the total weight of silica and alumina.

It has now been found that the incorporation in hydrated silica of smaller amounts of hydrated alumina than have hitherto been proposed results in a material which will develop a colour which is of good intensity and has good resistance to fading.

Accordingly, the present invention provides in a first aspect record maerial carrying a colour developer composition comprising a particulate amorphous hydrated silica/hydrated alumina composite in which the hydrated silica and hydrated alumina are chemically bound, characterized in that the mean alumina content of the composite on a dried weight basis is up to 7.5%, based on the total dry weight of silica and alumina.

In a second aspect, the present invention provides a process for the production of record material carrying a particulate amorphous hydrated silica/hydrated alumina composite in which the hydrated silica and hydrated alumina are chemically bound, comprising the steps of reacting hydrated silica and hydrated alumina together in an aqueous medium to produce a dispersion of said composite, applying a coating composition incorporating said composite to a substrate and drying the coated substrate to produce said record material, characterized in that the hydrated silica and hydrated alumina are reacted together in proportions such that the mean alumina content of the resulting composite on a dried weight basis is up to 7.5%, based on the total dry weight of silica and alumina.

Preferably, the alumina content of the composite on a dried weight basis is from 1.5 to 5%, and more preferably is from 2.5 to 4.0%, based on the total dry weight of alumina and silica in each case, although the preferred alumina content depends to some extent on the colour former being used.

The hydrated silica/hydrated alumina composite may be produced by reacting the hydrated silica and hydrated alumina together in any of a number of ways (it should be appreciated in this context that the hydrated silica and/or the hydrated alumina may itself be produced by precipitation at substantially the same time as the reaction between the hydrated silica and hydrated alumina takes place).

The preferred process route is to precipitate hydrated alumina from aqueous solution in the presence of previously-precipitated hydrated silica, with resultant deposition of the hydrated alumina on to the hydrated silica. This is though to result in the hydrated alumina being present in a greater proportion in a surface region of the particles of the composite than elsewhere. The previously precipitated hydrated silica used in the preferred route may be a material produced in a separate production process, for example a commercially available precipitated silica, or it may be a material which has been precipitated just previously as an earlier step in a single process for producing the composite. Alternative routes to the production of the composite include (a) the simultaneous precipitation of hydrated silica and hydrated alumina from the same aqueous medium i.e. the hydrated silica and hydrated alumina are reacted together as they are produced (b) the admixture of hydrated silica and recently-precipitated hydrated alumina, and (c) the treatment of previously-formed silica with aluminium oxide or hydroxide in an alkaline medium. In both route (b) and route (c) the silica may be freshly precipitated, but it need not be.

Precipitation of hydrated silica as part of any of the procedures just mentioned is conveniently carried out by treating a solution of sodium or potassium silicate with an acid, normally one of the common mineral acids such as sulphuric, hydrochloric or nitric acid.

Precipitation of hydrated alumina as part of any of the procedures just mentioned is conveniently carried out by treating a solution of a cationic aluminium salt with an alkaline material such as sodium or potassium hydroxide, although other alkaline materials may be used, for example lithium hydroxide, ammonium hydroxide or calcium hydroxide. It is normally convenient to use aluminium sulphate as the aluminium salt, but other aluminium salts may be used, for example aluminium nitrate or aluminium acetate.

When both the silica and alumina are to be precipitated simultaneously, there are a number of possible sequences of preparation steps. For example, a hydrated silica/hydrated alumina composition may be precipitated by acidifying a solution of sodium or potassium silicate to pH 7 (e.g. with sulphuric acid), adding aluminium sulphate and raising the pH with sodium or potassium hydroxide. Alternatively, an alumina-silica mixture may be obtained by mixing a solution of aluminium sulphate and sodium or potassium silicate, optionally whilst maintaining a high pH, and lowering the pH (e.g. with sulphuric acid) to bring about precipitation.

A further possibility is to precipitate hydrated silica and hydrated alumina from separate solutions and to admix the two precipitated materials whilst still fresh.

Instead of the use of a cationic aluminium salt, hydrated alumina may be precipitated from a solution of an aluminate, for example sodium or potassium aluminate, by addition of acid, e.g. sulphuric acid.

Preferably, the production of the composite by any of the foregoing routes takes place in the presence of a polymeric rheology modifier such as the sodium salt of carboxymethyl cellulose (CMC), polyethylene imine or sodium hexametaphosphate. The presence of such a material modifies the rheological properties of the hydrated silica/hydrated alumina dispersion and thus results in a more easily agitatable, pumpable and coatable composition, possibly by having a dispersing or flocculating action.

If the present material is formed by precipitation of hydrated silica in conjunction with precipitation of hydrated alumina, it is frequently advantageous to perform the precipitation in the presence of a particulate material which may function as a carrier or nucleating agent. Suitable particulate materials for this purpose include kaolin, calcium carbonate or other materials commonly used as pigments, fillers or extenders in the paper coating art, since these materials will normally be included in the final coating composition anyway.

The previously-formed hydrated silica which may be used in the preparation of the hydrated silica/hydrated alumina composite may in principle be any of the silicas which are commercially available, although it is conceivable that some materials may not be effective for some reason.

Preferably, the previously formed hydrated silica is a precipitated silica. Results obtained with a number of commercially-available silicas are detailed in the Examples set out hereafter, and these afford guidance as to suitable choice of material, whilst not of course obviating the need for routine experimentation and optimisation prior to manufacture of the colour developing composite.

In a preferred embodiment of the present invention, the colour developing composite is modified by the presence of one or more additional metal compounds or ions (the chemical nature of the metal modified material has not yet been fully elucidated, as discussed further hereafter). This enables substantial improvements to be achieved in the initial intensity, and fade resistance of the print obtained with so-called rapid-developing colour formers, and in reactivity towards so-called slow-developing colour formers. Categorisation of colour formers by the speed by which they bring about colour development has long been a common practice in the art. 3,3-bis(4'-dimethylaminiophenyl)-6-dimethylaminophthalide (CVL) and simila lactone colour formers are typical of the rapid-developing class, in which colour formation results from cleavage of the lactone ring on contact with an acid co-reactant. 10-benzoyl-3,7-bis(dimethylamino)phenothiazine (more commonly known as benzoyl leuco methylene blue or BLMB) and 10-benzoyl-3,7-bis(di-ethylamino)phenoxazine (also known as BLASB) are examples of the slow-developing class. It is generally believed that formation of a coloured species is a result of slow hydrolysis of the benzoyl group over a period of up to aout two days, followed by aerial oxidation.

Other colour formers are known in the art of which the speed of development is intermediate between the so-called rapid-developing and slow-developing colour formers. This intermediate category is exemplified by spiro-bipyran colour formers which are widely disclosed in the patent literature. Modification of the present hydrated silica/hydrated alumina composite with metal compounds or ions has also been found to enhance colour developing performance with respect to these intermediate-developing colour formers.

The effect achieved by modification with metal compounds or ions depends on the particular metal involved and the particular colour former(s) being used. A wide range of metals can be used for modification, see for instance those listed in Example 7 hereafter. Copper is the preferred modifying metal.

Metal modification may conveniently be brought about by treating the hydrated silica/hydrated alumina composite, once formed, with a solution of the metal salt, for example the sulphate or nitrate. Alternatively, a solution of the metal salt may be introduced into the medium from which the hydrated alumina, and possibly also the hydrated silica, is deposited. The latter technique has in some instances been found to modify the rheological properties of the hydrated silica/hydrated alumina dispersion so as to make it more easily agitatable, pumpable and coatable. In the preferred embodiment of the process in which the hydrated alumina is precipitated from aqueous solution in the presence of previously precipitated hydrated silica, the modifying metal compound is present during the precipitation of the hydrated alumina, or is introduced as a sequential step after that reaction. This is thought to result in the modifying metal being present in a greater proportion in a surface region of the particles of the composite than elsewhere.

As previously stated, the precise nature of the species formed during metal-modification has not so far been fully elucidated, but one possibility is that a metal oxide or hydroxide is precipitated so as to be present in the alumina/silica composite. An alternative or additional possibility is that ion-exchange occurs so that metal ions are present at ion-exchange sites on the surface of the silica alumina composite.

When copper is used as the modifying metal, the amount used is preferably from 2.0 to 4.0% by weight, on a dried weight basis, calculated as weight of cupric oxide to total weight of silica, alumina and cupric oxide (this assumes the first of the two possibilities discussed in the previous paragraph).

The surface area of the hydrated silica/hydrated alumina composite is preferably below 300 $m^2g^{-1}$. In order to achieve this in the case of a precipitated silica, it is necessary to avoid many of the steps which are commonly used in the commercial manufacture of silica by precipitation from sodium silicate (higher surface areas are normally needed for most commercial applications of silica). These steps typically include hot water storage of precipitated silica and subsequent roasting of the precipitate when separate from the aqueous medium in which it was formed.

However, if a previously-formed silica is used as the starting material, it may have a surface area above 300 $m^2g^{-1}$, (say up to about 350 $m^2g^{-1}$) and yet still afford a silica/alumina composite having a surface area below 300 $m^2g^{-1}$, since the effect of aluminium deposition is to lower the surface area. For example, a 320 $m^2g^{-1}$ commercially available silica was found to have a surface area of about 250 $m^2g^{-1}$ after treatment to deposit alumina. A similar lowering of surface area is observed to result from metal modification.

It is found that too low a surface area tends to give a material of insufficient reactivity for good colour developing properties. In general therefore the hydrated silica/hydrated alumina composite should have a surface area not lower than about 100 $m^2g^{-1}$, and preferably this surface area should be above 150 $m^2g^{-1}$.

The hydrated silica/hydrated alumina composite is normaly used in a composition also containing a binder (which may be wholly or in part constituted by the CMC preferably used as a dispersant during the preparation of the colour developing material) and/or a filler or extender, which typically is kaolin, calcium carbonate or a synthetic paper coating pigment, for example a urea formaldehyde resin pigment.

The filler or extender may be wholly or in part constituted by the particulate material which may be used during the preparation of the hydrated silica/hydrated alumina composite. The pH of the coating composition influences the subsequent colour developing performance of the composition, and also its viscosity, which is significant in terms of the ease with which the composition may be coated on to paper or other sheet material. The preferred pH for the coating composition is within the range 5 to 9.5, and is preferably around 7. Sodium hydroxide is conveniently used for pH adjustment, but other alkaline materials may be used, for example potassium hydroxide, lithium hydroxide, calcium hydroxide, ammonium hydroxide, sodium silicate, or potassium silicate.

The hydrated silica/hydrated alumina composite may be used as the only colour developing material in a colour developing composition, or it may be used together with other colour developing materials, e.g. an acid-washed dioctahedral montmorillonite clay, a phenolic resin, or a salicylic acid derivative. Mixture with acid-washed dioctahedral montmorillonite clay, for example in equal amounts on a weight basis, has been found to offer particular advantage.

It is usually desirable to treat the hydrated silica/hydrated alumina composite in order to break up any aggregates which have formed. This is especially true in the case of a composite produced by a process in which both the hydrated silica and hydrated alumina are precipitated. The preferred treatment is ball-milling, and it may be carried out before or after fillers or additional colour developing materials are added (if they are added at all). The preferred final mean volume particle size is desirably about 3.0 to 3.5 μm. Whilst improvements in reactivity may be achievable below this size, they tend to be counteracted by disadvantageously high viscosities. A suitable instrument for measurement of particle size is a Coulter Counter with a 50 μm tube.

At least in the case of hydrated silica/hydrated alumina composites produced by a process in which both the hydrated silica and hydrated alumina are precipitated, it has been found that enhanced colour developing performance tends to result if the freshly prepared composite is left in dispersion for a few hours, for example overnight, before being coated on to a suitable substrate. The reasons for this have not been fully elucidated.

It has been found that the reactivity of the preferred composites do not significantly decline progressively with time, which is a drawback of a number of widely used colour developing materials. The effect of such decline is that the intensity of print obtained using a freshly-manufactured colour developing sheet is considerably greater than that obtained with the same sheet a few days later, and this intensity is in turn considerably greater than that obtained with the same sheet a few months later. This is a serious drawback, since the colour developer sheet is frequently not used until many months after it has been manufactured. This is because the chain of distribution is frequently from the paper manufacturer to a wholesaler to a printer and thence to the end user. This means that in order to guarantee that the intensity of print will be acceptable to the end user many months after the paper has been manufactured, the manufacturer must use a greater amount of reactive material in the production of the colour developing sheets than is needed to produce a print on those sheets immediately after manufacture. Since the colour developing material is expensive, this adds significantly to the cost of pressure-sensitive copying systems. The fact that the hydrated silica/hydrated alumina composite used in the present recording material obviates this problem is thus a major benefit.

The record sheet may carry the colour developing material as a coating, in which case it may form part of a transfer or self-contained pressure-sensitive copying system or of a heat-sensitive recording system as described previously. Alternatively, however, it may carry the colour developing material as a loading. Such a loaded sheet may be used in the same manner as the coated record sheet just described, or it may be used in a sheet which also carries microencapsulated colour former solution as a loading, i.e. in a self-contained copying system.

The invention will now be illustrated by the following Examples (in which all percentages quoted are on a weight for weight basis):

EXAMPLE 1

This illustrates the production of record material utilising a hydrated silica/hydrated alumina composite formed by deposition of hydrated alumina on to a previously-formed hydrated silica (Gasil 35 supplied by Joseph Crosfield & Sons Ltd., of Warrington, England).

2.4 g of CMC (FF5 supplied by Finnfix of Finland) were dissolved in 210 g of de-ionized water over a period of 15 minutes with stirring. 70.0 g silica were added followed by 10.9 g of aluminium sulphate, $Al_2(SO_4)_3.16H_2O$. The mixture was left stirring for more than an hour. 14.3 g of kaolin (Dinkie A supplied by English China Clays Ltd.) was then added and the mixture was stirred for a further half-hour. The pH of the mixture was then adjusted to 9.5 by the addition of sodium hydroxide, after which 20.2 g of a styrene-butadiene latex binder were added (Dow 620 supplied by Dow Chemical). The pH was then re-adjusted to 9.5. Sufficient water was then added to lower the viscosity of the mixture to a value suitable for coating using a laboratory Meyer bar coater. The mixture was then coated on to paper at a nominal coat weight of 8 $gm^{-2}$, and the coated sheet was then dried and calendered, and then subjected to calender intensity and fade resistance tests to assess its performance as a colour developing material.

The procedure was then repeated, but without the inclusion of aluminium sulphate, in order to provide a comparison with the colour developing properties of the silica alone, i.e. a control sheet.

The calender intensity test involved superimposing strips of paper coated with encapsulated colour former solution onto a strip of the coated paper under test, passing the superimposed strips through a laboratory calender to rupture the capsules and thereby produce a colour on the test strip, measuring the reflectance of the thus coloured strip (I) and expressing the result ($I/I_o$) as a percentage of the reflectance of an unused control strip ($I_o$). Thus the lower the calender intensity value ($I/I_o$) the more intense the developed colour.

The calender intensity tests were done with two different papers, designated hereafter as Papers A and B. Paper A employed a commercially used colour former blend containing, inter alia, CVL as a rapid-developing colour former and BLASB as a slow-developing colour former. Paper B employed an experimental colour former blend including CVL, a slow-developing blue colour former and an intermediate-developing colour former which was a spiro-bipyran derivative.

The reflectance measurements were done both two minutes after calendering and forty-eight hours after calendering, the sample being kept in the dark in the interim. The colour developed after two minutes is primarily due to the rapid-developing colour formers, whereas the colour after forty-eight hours derives also from the slow-developing colour formers, (fading of the colour from the rapid-developing colour formers also influences the intensity achieved). The spiro-bipyran derivative, when present, tends to develop most of its colour within two minutes, whilst not being almost instantaneous as is the case with CVL.

The fading test involved positioning the developed strips (after forty-eight hours development) in a cabinet in which were an array of daylight fluorescent strip lamps, and was intended to simulate in accelerated form, the fading which a print might undergo under normal conditions of use. After exposure for the desired time, measurements were made as described with reference to the calender intensity test, and the results were expressed in the same way.

The results obtained were as follows.

| Test Conditions | Test Materials Intensity ($I/I_o$) | | | |
|---|---|---|---|---|
| | Ex. 1/ Paper A | Control/ Paper A | Ex. 1/ Paper B | Control/ Paper B |
| 2 min development | 46.6 | 48.7 | 43.6 | 49.4 |
| 48 hour development | 36.9 | 38.2 | 36.3 | 41.7 |
| 1 hour fade | 37.4 | 46.2 | 35.2 | 53.0 |
| 3 hour fade | 39.7 | 54.5 | 39.1 | 63.1 |
| 5 hour fade | 43.4 | 62.9 | 43.8 | 73.2 |
| 10 hour fade | 48.8 | 69.5 | 55.8 | 78.3 |
| 15 hour fade | 57.0 | 74.3 | 62.5 | 83.5 |
| 30 hour fade | 63.2 | 83.4 | 70.5 | 89.6 |
| 50 hour fade | 67.3 | 89.4 | 75.4 | 91.0 |
| 100 hour fade | 72.2 | 91.0 | 80.3 | 93.0 |

It will be seen that the paper coated with the present colour developing material performed better than control for both intensity of colour development and fade resistance.

EXAMPLE 2

This illustrates the use of a range of other aluminium compounds in place of the aluminium sulphate used in Example 1. These compounds were aluminium nitrate, aluminium oxide, and aluminium hydroxide. The procedure was as described in Example 1, except that the amounts of aluminium compound used were adjusted to give the same alumina content in the colour developing material as in Example 1, i.e. 6.8 g aluminium nitrate, 1.5 g aluminium oxide, and 2.3 g aluminium hydroxide. The amount of kaolin used was adjusted in consequence in each case to give approximately the same solids content mix (before dilution to facilitate coating).

The results obtained were as follows:

| Test Conditions | Test Materials Intensity ($I/I_o$) | | | | | |
|---|---|---|---|---|---|---|
| | Paper A | | | Paper B | | |
| | $Al(NO_3)_3$ | $Al_2O_3$ | $Al(OH)_3$ | $Al(NO_3)_3$ | $Al_2O_3$ | $Al(OH)_3$ |
| 2 min development | 47.7 | 47.9 | 47.4 | 48.7 | 49.8 | 47.4 |
| 48 hour development | 35.6 | 35.6 | 35.4 | 39.4 | 41.7 | 41.3 |
| 1 hour fade | 36.0 | 39.6 | 39.7 | 38.3 | 44.8 | 45.3 |
| 2 hour fade | 41.8 | 47.8 | 48.3 | 43.1 | 56.1 | 57.2 |
| 5 hour fade | 44.5 | 54.1 | 54.1 | 45.6 | 62.1 | 63.0 |
| 10 hour fade | 52.0 | 61.5 | 61.6 | 52.0 | 70.9 | 72.0 |
| 15 hour fade | 57.8 | 65.6 | 66.6 | 58.3 | 76.7 | 77.6 |
| 30 hour fade | 63.2 | 70.4 | 72.3 | 68.1 | 81.5 | 82.2 |
| 50 hour fade | 67.5 | 79.0 | 80.0 | 73.0 | 85.0 | 85.5 |
| 100 hour fade | 72.2 | 82.7 | 83.5 | 83.6 | 89.1 | 89.9 |

It will be seen (by comparison with the control results quoted in Example 1) that paper coated with the present colour developing material performed better than control for both intensity of colour development and fade resistance.

EXAMPLE 3

This illustrates the use of different percentages of alumina to previously-formed silica. The procedure was as described in Example 1, except that the quantities of aluminium sulphate, $Al_2(SO_4)_3 \cdot 16H_2O$, were as follows: 7.2 g, 14.6 g, 18.0 g and 21.7 g. The quantity of kaolin was adjusted in consequence to maintain an approximately constant solids content. The amounts of alumina on a dried weight basis were thus 1.5, 2.8, 3.3 and 3.8% of the total dry weight of alumina and silica (in Example 1, the corresponding percentage was 2.5%).

The results obtained were as follows:

| Test Conditions | Test Materials Intensity ($I/I_0$) Paper A % Alumina 1.6 | 3.2 | 4.0 | 4.8 | Paper B % Alumina 1.6 | 3.2 | 4.0 | 4.8 |
|---|---|---|---|---|---|---|---|---|
| 2 min development | 47.1 | 47.8 | 51.9 | 50.7 | 44.7 | 43.8 | 45.2 | 45.4 |
| 48 hour development | 39.3 | 37.3 | 39.9 | 40.4 | 39.1 | 35.6 | 37.6 | 39.1 |
| 1 hour fade | 40.5 | 35.8 | 39.9 | 38.9 | 39.2 | 35.4 | 39.4 | 40.2 |
| 3 hour fade | 44.5 | 39.7 | 43.7 | 42.8 | 44.7 | 39.2 | 43.4 | 45.9 |
| 5 hour fade | 48.8 | 43.9 | 47.2 | 48.7 | 48.8 | 42.3 | 47.5 | 50.4 |
| 10 hour fade | 56.9 | 50.4 | 53.1 | 55.0 | 58.5 | 50.5 | 57.4 | 59.6 |
| 15 hour fade | 63.5 | 59.5 | 61.2 | 62.5 | 67.8 | 60.6 | 68.1 | 71.2 |
| 30 hour fade | 68.4 | 65.3 | 66.4 | 67.8 | 74.3 | 68.9 | 74.1 | 76.9 |
| 50 hour fade | 72.6 | 69.2 | 71.0 | 72.4 | 78.3 | 74.9 | 77.7 | 80.2 |
| 100 hour fade | 75.7 | 74.4 | 74.1 | 75.9 | 83.0 | 80.5 | 82.0 | 83.6 |

Figure 2:
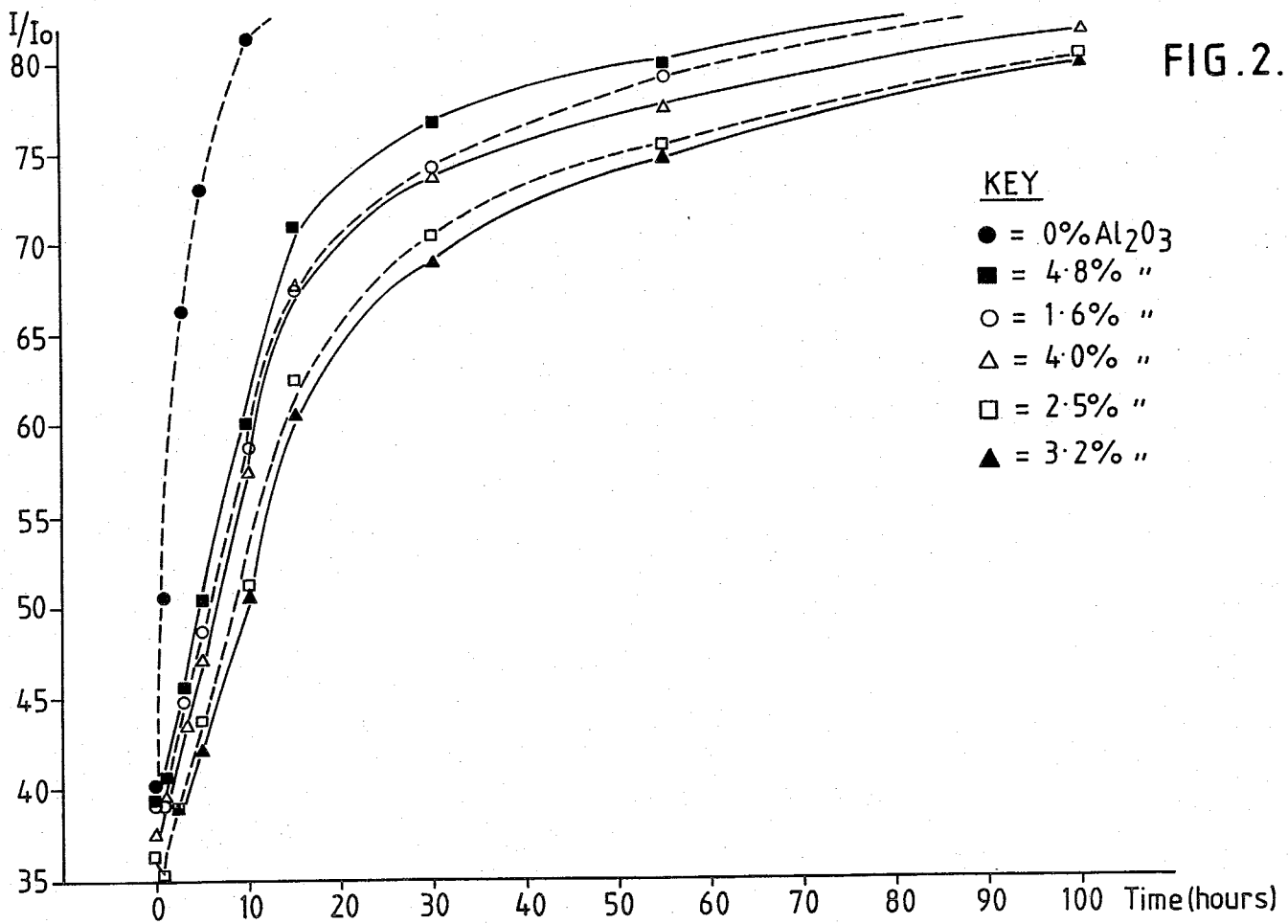

A plot of intensity ($I/I_0$) against time for which the sample was faded is shown in FIGS. 1 and 2 (the results from Example 1 also being included). It will be seen that the best fade resistance is with 2.5%, 3.2% and 4.0% alumina. (FIGS. 1 and 2 relate to Papers A and B respectively). The surface area of the 2.8% alumina material was found to be about 280 $m^2/g$ when measured by the BET nitrogen absorption method.

EXAMPLE 4

This illustrates the use of two alternative previously formed silicas in place of the Gasil 35 used in Example 1, namely (a) DK 320 supplied by Degussa and (b) Syloid 266 supplied by Grace The procedure used was as described in Example 1 except that the quantities of material (g) used were as follows:

| Material | (a) | Control (a) | (b) | Control (b) |
|---|---|---|---|---|
| De-ionized water | 315 | 318 | 76 | 77 |
| CMC | 2.4 | 2.4 | 0.48 | 0.48 |
| $Al_2(SO_4)_3 \cdot 16H_2O$ | 9.3 | — | 1.85 | — |
| Silica | 67.2 | 67.2 | | |
| Kaolin | 14.3 | 19.4 | 2.9 | 3.9 |
| Latex | 20.2 | 20.2 | 4.0 | 4.0 |

The results obtained using DK 320 were as follows:

| Test Conditions | Test Materials Intensity ($I/I_0$) Ex. 4/ Paper A | Control/ Paper A | Ex. 4 Paper B | Control/ Paper B |
|---|---|---|---|---|
| 2 min. development | 57.7 | 55.7 | 54.0 | 56.0 |
| 48 hour development | 40.5 | 41.1 | 41.9 | 46.8 |
| 1 hour fade | 41.6 | 46.8 | 41.2 | 52.0 |
| 3 hour fade | 46.9 | 57.4 | 49.5 | 65.8 |
| 5 hour fade | 51.4 | 62.6 | 54.1 | 70.1 |
| 10 hour fade | 56.4 | 68.9 | 62.4 | 79.6 |

The results obtained using Syloid were as follows:

| Test Conditions | Test Materials Intensity ($I/I_0$) Ex. 4/ Paper A | Control/ Paper A | Ex. 4 Paper B | Control/ Paper B |
|---|---|---|---|---|
| 2 min. development | 51.5 | 50.8 | 48.6 | 52.5 |
| 48 hour development | 40.2 | 41.2 | 43.3 | 46.3 |
| 1 hour fade | 45.3 | 47.8 | 45.4 | 58.0 |
| 3 hour fade | 52.0 | 54.0 | 49.4 | 67.5 |
| 5 hour fade | 60.6 | 62.3 | 59.4 | 76.5 |
| 10 hour fade | 66.6 | 68.2 | 67.1 | 81.8 |

EXAMPLE 5

This illustrates the effect of adjustment to pH levels (using sodium hydroxide) other than the 9.5 used in Example 1.

The procedure used was as described in Example 1, but with the following quantities of materials:

| | |
|---|---|
| De-ionized water | 210 g |
| CMC | 2.4 g |
| $Al_2(SO_4)_3 \cdot 16H_2O$ | 12.4 g |
| Silica (Gasil 35) | 70.0 g |
| Kaolin | 12.6 g |
| Latex | 20.0 g |

The results obtained using Paper were as follows:

| Test Conditions | pH value 7.0 | 8.0 | 8.6 | 9.7 | 10.5 |
|---|---|---|---|---|---|
| 2 min. development | 44.7 | 45.3 | 44.2 | 45.8 | 48.2 |
| 48 hour development | 33.2 | 33.9 | 33.9 | 35.4 | 38.1 |
| 1 hour fade | 33.5 | 34.7 | 35.9 | 39.4 | 45.7 |
| 3 hour fade | 39.5 | 41.4 | 42.6 | 46.1 | 56.5 |
| 5 hour fade | 40.7 | 43.5 | 47.6 | 53.2 | 64.8 |
| 10 hour fade | 44.4 | 51.0 | 56.1 | 64.5 | 72.3 |
| 15 hour fade | 50.6 | 58.1 | 62.6 | 70.2 | 75.0 |
| 30 hour fade | 61.4 | 67.6 | 70.1 | 74.7 | 79.7 |
| 50 hour fade | 67.6 | 73.8 | 73.9 | 77.5 | 82.6 |
| 100 hour fade | 76.3 | 78.8 | 78.3 | 82.8 | 87.2 |

The results obtained using Paper B were as follows:

| Test Conditions | pH value 7.0 | 8.0 | 8.6 | 9.7 | 10.5 |
|---|---|---|---|---|---|
| 2 min. development | 43.4 | 44.0 | 43.4 | 43.6 | 47.6 |
| 48 hour development | 33.3 | 35.4 | 34.8 | 36.9 | 41.1 |
| 1 hour fade | 33.2 | 34.9 | 36.0 | 38.0 | 45.7 |
| 3 hour fade | 36.3 | 41.0 | 40.8 | 41.8 | 58.6 |
| 5 hour fade | 37.9 | 41.5 | 43.8 | 56.0 | |
| 10 hour fade | 44.4 | 47.1 | 49.8 | 60.5 | 77.3 |
| 15 hour fade | 49.4 | 53.2 | 57.8 | 68.0 | 82.8 |
| 30 hour fade | 62.6 | 66.7 | 70.5 | | |
| 50 hour fade | 72.7 | 74.4 | — | | |

-continued

| Test Conditions | pH value 7.0 | 8.0 | 8.6 | 9.7 | 10.5 |
|---|---|---|---|---|---|
| 100 hour fade | 83.4 | 85.1 | 86.7 | 84.0 | 91.6 |

It will be seen that fade resistance is best ar around pH 7.

EXAMPLE 6

This demonstrates that alkaline materials other than sodium hydroxide may be satifactorily used to adjust pH.

The quantities of materials used were as set out in Example 5, and the pH was adjusted to 7 using the following materials-sodium silicate, ammonium hydroxide, potassium hydroxide, calcium hydroxide, potassium silicate, lithium hydroxide. The procedure employed was generally as described in Example 1.

The results obtained using Paper A were as follows:

| Test Conditions | pH adjuster Intensity ($I/I_o$) Sodium silicate | $NH_4OH$ | KOH* | $Ca(OH)_2$ | Potassium silicate | LiOH |
|---|---|---|---|---|---|---|
| 2 min. development | 42.0 | 44.7 | 48.1 | 50.0 | 46.0 | 45.3 |
| 48 hour development | 34.3 | 33.9 | 38.0 | 39.1 | 35.9 | 34.2 |
| 1 hour fade | 36.6 | 35.6 | 38.4 | 39.3 | 38.2 | 33.4 |
| 3 hour fade | 43.3 | 39.6 | 44.5 | 41.2 | 43.6 | 34.7 |
| 5 hour fade | 49.0 | 44.0 | 50.9 | 43.3 | 47.4 | 36.7 |
| 10 hour fade | 57.1 | 53.3 | 61.4 | 48.5 | 55.3 | 42.5 |
| 15 hour fade | 63.0 | 58.2 | 68.0 | 54.1 | 61.0 | 49.3 |
| 30 hour fade | 68.4 | 64.4 | 73.7 | 62.9 | 67.2 | 60.1 |
| 50 hour fade | 73.0 | 70.0 | 76.4 | 71.1 | 71.4 | 68.6 |
| 100 hour fade | 80.8 | 77.6 | 82.2 | 77.2 | 76.1 | 75.3 |

*For KOH, the pH was adjusted to 8.0

The results obtained using Paper B were as follows:

| Test Conditions | pH adjuster Intensity ($I/I_o$) Sodium silicate | $NH_4OH$ | KOH* | $Ca(OH)_2$ | Potassium silicate | LiOH |
|---|---|---|---|---|---|---|
| 2 min. development | 43.4 | — | 47.2 | 45.4 | 42.9 | 42.1 |
| 48 hour development | 34.4 | — | 39.8 | 38.8 | 36.1 | 35.3 |
| 1 hour fade | 34.2 | — | 37.7 | 38.9 | 37.8 | 34.0 |
| 3 hour fade | 37.4 | — | 43.5 | 40.7 | 41.1 | 34.7 |
| 5 hour fade | 43.0 | — | 49.2 | 42.3 | 44.8 | 36.1 |
| 10 hour fade | 52.8 | — | 60.8 | 47.8 | 52.6 | 42.1 |
| 15 hour fade | 61.0 | — | 70.5 | 54.7 | 60.1 | 47.1 |
| 30 hour fade | 69.3 | — | 77.1 | 64.9 | 70.5 | 59.0 |
| 50 hour fade | 74.8 | — | 82.7 | 74.8 | 77.1 | 69.6 |
| 100 hour fade | 82.5 | — | 88.1 | 83.7 | 83.9 | 77.0 |

*For KOH, the pH was adjusted to 8.0

EXAMPLE 7

This illustrates the production of record material utilising a hydrated silica/hydrated alumina composite modified with metal compounds.

Sodium hydroxide was added to 105 g de-ionized water so as to give a pH of 14. 1.2 g of CMC (FF5) were dissolved in this alkaline medium over a period of 15 minutes with stirring. 22.5 g of silica (Gasil 35) were added, followed by 4.5 g of aluminum sulphate, $Al_2(SO_4)_3 \cdot 16H_2O$. The mixture was left stirring for more than an hour. xg of metal salt were then added (the nature of x being set out hereafter) and the mixture was stirred for a further hour. 16.0 g of kaolin (Dinkie A) were then added, and the mixture was stirred for a further half-hour. The pH was then adjusted to 7 using sodium hydroxide, after which 10.0 g of styrene-butadiene latex (Dow 675 supplied by Dow Chemical) were added. The pH was re-adjusted to 9.5. Sufficient water was then added to lower the viscosity of the mixture to a value suitable for coating using a laboratory Meyer bar coater. The mixture was then coated on to paper at a nominal coat weight of 8 g $m^{-2}$ and the coated sheet was then dried and calendered. Calender intensity and fade resistance tests were then carried out.

These tests used in some cases Paper A as described earlier—but also a paper having a commercially used blend of colour formers giving a black copy (Paper C), and papers in which CVL and BLASB were used as the sole colour formers (Papers D and E respectively).

The metal salts and the quantities, xg, used were as follows:

| | | |
|---|---|---|
| Copper sulphate | $CuSO_4.5H_2O$ | 4.5 g |
| Manganese sulphate | $MnSO_4.4H_2O$ | 1.6 g |
| Cobalt sulphate | $CoSO_4.7H_2O$ | 4.0 g |
| Chromium nitrate | $Cr(NO_3)_3.9H_2O$ | 3.0 g |
| Nickel sulphate | $NiSO_4.6H_2O$ | 3.8 g |
| Titanium sulphate | $Ti(SO_4)_2$ (aq) | 1.9 g |
| Zinc sulphate | $ZnSO_4.7H_2O$ | 4.1 g |
| Zirconyl chloride | $ZrOCl_2.8H_2O$ | 1.4 g |
| Stannic chloride | $SnCl_4.5H_2O$ | 1.1 g |
| Calcium sulphate | $CaSO_4$ | 1.3 g |
| Phosphotungstic acid | $H_4W_{12}PO_{4o}.xH_2O$ | 1.0 g |
| Magnesium sulphate | $MgSO_4$ | 1.9 g |
| Sodium molybdate, | $Na_2MbO_42H_2O$ | 1.0 g |
| Niobium oxide | $Nb_2O_5$ | 0.55 g |

For comparison purposes the procedure was repeated using firstly Gasil 35 without using aluminum sulphate or any of the above metal compounds (Control 1) and secondly Gasil 35 and aluminum sulphate but without any of the above metal compounds (Control 2).

The results obtained are set out below, the key to the treatment conditions being as follows:

a=2 min. colour development b=48 hour development (in the dark)

c=fading for 16 hours after completion of the above 48 hour development.

| Treating | Intensity ($I/I_o$) Paper A | | | Paper C | | | Paper D | | | Paper E | | |
|---|---|---|---|---|---|---|---|---|---|---|---|---|
| Metal | a | b | c | a | b | c | a | b | c | a | b | c |
| None | 45.6 | 39.4 | 63.3 | 51.2 | 44.4 | 62.0 | 60.0 | 55.3 | 92.5 | 100 | 98.6 | 77.3 |

-continued

| Treating Metal | Intensity ($I/I_o$) Paper A a | Paper A b | Paper A c | Paper C a | Paper C b | Paper C c | Paper D a | Paper D b | Paper D c | Paper E a | Paper E b | Paper E c |
|---|---|---|---|---|---|---|---|---|---|---|---|---|
| Al | 46.4 | 36.5 | 39.3 | 51.4 | 44.5 | 45.9 | 55.6 | 49.8 | 61.6 | " | 99.0 | 72.6 |
| Al + Cu | 44.5 | 34.8 | 38.0 | 50.7 | 41.4 | 43.6 | 53.9 | 48.2 | 56.1 | " | 79.6 | 70.1 |
| Al + Mn | 43.5 | 34.5 | 50.4 | 50.7 | 41.1 | 55.5 | 53.1 | 47.2 | 77.0 | " | 87.6 | 71.1 |
| Al + Co | 44.0 | 35.6 | 35.6 | 49.0 | 42.8 | 43.9 | 51.5 | 47.9 | 57.9 | " | 97.7 | 73.6 |
| Al + Cr | 43.2 | 34.4 | 41.7 | 47.9 | 41.9 | 49.3 | 52.3 | 49.3 | 65.1 | " | 97.8 | 72.6 |
| Al + Ni | 41.6 | 32.6 | 33.7 | 47.6 | 42.1 | 40.2 | 56.1 | 50.5 | 55.7 | " | 97.8 | 70.2 |
| Al + Ti | 41.1 | 33.0 | 39.7 | 47.7 | 40.8 | 46.5 | 50.8 | 47.2 | 55.7 | " | 98.6 | 68.8 |
| Al + Zn | 43.6 | 34.0 | 39.6 | 45.8 | 41.2 | 45.1 | 54.6 | 49.0 | 62.5 | " | 98.8 | 71.0 |
| Al + Zr | 42.9 | 34.5 | 38.0 | 49.9 | 42.2 | 45.3 | 57.0 | 52.8 | 64.1 | " | 95.9 | 72.0 |
| Al + Sn | 43.0 | 34.1 | 37.0 | 49.5 | 42.3 | 44.4 | 56.6 | 51.2 | 62.8 | " | 98.0 | 70.7 |
| Al + Ca | 43.9 | 34.8 | 37.7 | 49.3 | 41.7 | 44.6 | 54.3 | 48.2 | 62.6 | " | 97.6 | 70.8 |
| Al + Mg | 44.0 | 34.8 | 39.1 | 49.3 | 41.2 | 45.7 | 54.1 | 47.2 | 61.8 | " | 98.5 | 72.6 |
| Al + W | 44.6 | 35.7 | 44.8 | 49.9 | 43.1 | 52.9 | 54.8 | 48.2 | 64.6 | " | 98.6 | 82.4 |
| Al + Mo | 44.0 | 35.3 | 41.4 | 50.7 | 42.9 | 47.4 | 56.5 | 49.8 | 62.8 | " | 98.8 | 71.4 |
| Al + Nb | 45.1 | 36.2 | 40.8 | 49.3 | 42.2 | 47.0 | 54.7 | 47.5 | 60.0 | " | 97.5 | 72.2 |

EXAMPLE 8

This illustrates the production of record material utilising a hydrated silica/hydrated alumina composite formed by a method in which both the silica and the alumina are precipitated simultaneously. 4.8 g of CMC (FF5) were dissolved in 280.0 g de-ionized water over a period of 15 minutes with stirring. 188 g of (48% solids content) sodium silicate solution (Pyramid 120 supplied by Joseph Crosfield & Sons Ltd.) were then added, with continued stirring. When the sodium silicate had been dispersed, 50.0 g of a 40% w/w solution of aluminium sulphate, $Al_2(SO_4)_3 \cdot 16H_2O$ were added, and the mixture was stirred for more than an hour. Sulphuric acid (40% w/w) was then added dropwise over a period of at least half an hour until pH 7.0 was reached. Addition of sulphuric acid brings about precipitation, which results in mix thickening. In order to avoid gelling, the addition of sulphuric acid must be stopped when thickening commences, and continued only after stirring for a period sufficient to allow equilibration to occur. 44.0 g of kaolin (Dinkie A) were added when acid addition was complete, and the mixture was stirred for a further half-hour. 40.0 g of styrene-butadiene latex (Dow 675) were then added, and the pH was re-adjusted to 7.0. Sufficient water was then added to lower the viscosity of the mixture to a value suitable for coating using a laboratory Meyer bar coater. The mixture was then coated on to paper at a nominal coatweight of 8 $gm^{-2}$, and the coated sheet was then dried and calendered and subjected to calender intensity and fade tests as described earlier.

The amount of alumina in the hydrated silica/hydrated alumina material prepared as just described was 5.1% on a dried weight basis of the total weight of alumina and silica.

The intensity value ($I/I_o$) obtained with Paper A was 52 for 2 minute development, 47 for 48 hour development and 60 after 16 hours fading.

The surface area of the hydrated silica/hydrated alumina composite produced as described above was found to be about 250 $m^2g^{-1}$, as measured by the B.E.T. nitrogen absorption method.

EXAMPLE 9

This illustrates the production of record material utilising a copper-modified hydrated silica/hydrated alumina composite formed by a method in which both the silica and the alumina are precipitated simultaneously.

The procedure was as described in Example 8 except that after addition of the 50.0 g of aluminium sulphate and stirring for only about 15 minutes, 96.0 g of 20% w/w, copper sulphate, $CuSO_4$, $5H_2O$ were added, followed by stirring for more than an hour. The addition of sulphuric acid and the subsequent procedure was as described in Example 8.

The procedure was then repeated using different quantities of 40% w/w aluminium sulphate, $Al_2(SO_4)_3 \cdot 16H_2O$, namely 25 g, 60 g and 75 g, giving alumina percentages (on the same basis as set out in Example 8) of 2.6%, 6.1% and just under 7.5%.

The calender intensity and fade resistance tests were carried out using Papers A and C as previously described.

The surface area of the hydrated silica/hydrated alumina composite produced as described above was found to be about 175 $m^2g^{-1}$ as measured by the B.E.T. nitrogen absorption method.

The results were as follows:

| Test Conditions | % of $Al_2O_3$ Intensity ($I/I_o$) Paper A 2.6 | Paper A 5.1 | Paper A 6.1 | Paper A 7.5 | Paper C 2.6 | Paper C 5.1 | Paper C 6.1 | Paper C 7.5 |
|---|---|---|---|---|---|---|---|---|
| 2 min. development | 51.0 | 47.2 | 45.6 | 48.2 | 60.0 | 54.1 | 53.0 | 56.8 |
| 48 hour development | 45.3 | 40.6 | 39.4 | 43.2 | 52.4 | 46.4 | 46.8 | 48.0 |
| 5 hour fade | 55.3 | 49.0 | 48.2 | 51.7 | 60.0 | 53.8 | 54.0 | 56.0 |

EXAMPLE 10

This illustrates the production of record material utilising a hydrated silica/hydrated alumina composite formed by deposition of hydrated alumina on to previously formed hydrated silica, but using a mix pH of 7.0 instead of the pH of 9.5 used in Example 1 and 3, which describe to the production of a composite by an otherwise similar process. The procedure employed was as set out in Examples 1 and 3 apart from the adjustment of pH to 7.0 rather than 9.5.

The results obtained (using Paper A) were as follows:

| Test Conditions | % $Al_2O_3$ Intensity ($I/I_0$) 0% | 1.6% | 2.5% | 3.2% | 4.0% | 4.8% |
|---|---|---|---|---|---|---|
| 2 min. development | 45.3 | 43.2 | 41.9 | 40.1 | 38.9 | 41.1 |
| 48 hour development | 38.1 | 34.8 | 34.6 | 33.4 | 32.0 | 33.0 |
| 1 hour fade | 42.5 | 34.0 | 32.3 | — | 30.6 | — |
| 3 hour fade | 48.6 | 35.0 | 33.8 | — | 30.8 | — |
| 5 hour fade | 53.6 | 38.1 | 36.2 | — | 33.6 | — |
| 10 hour fade | 65.6 | 45.3 | 42.6 | — | 38.0 | — |

EXAMPLE 11

This illustrates the use of a range of different extenders in a coating composition containing a hydrated silica/hydrated alumina composite.

The procedure employed was generally as described in Example 1, except that firstly that the first stage of the process was to add sodium hydroxide to the de-ionized water, before dissolving the CMC, secondly, that the pH was adjusted at the end of the process to 7.0 rather than 9.5 and thirdly that the following quantities of materials were employed, Xg of extender Y replacing the 14.3 g kaolin used in Example 1:

| | |
|---|---|
| De-ionized water | 100 g |
| CMC (FF5) | 1.2 g |
| Sodium hydroxide (40% w/w solution) | 3.8 g |
| Silica (Gasil 35) | 12.3 g |
| Aluminium sulphate, $Al_2(SO_4)_3$, $16H_2O$ | 6.9 g |
| Extender Y | Xg |

| | Extender Y | Xg |
|---|---|---|
| (a) | kaolin (Dinkie A) | 11.0 |
| (b) | organic pigment sold as DPP by Dow | 11.0 |
| (c) | urea-formaldehyde pigment (Pergopak M2 supplied by Ciba-Geigy) | 5.0 |
| (d) | organic pigment sold as Realite 85 by Hercules | 11.0 |
| (e) | calcium carbonate (Snoweal 7M1 Supplied by Blue Circle Industries) | 11.0 |

EXAMPLE 12

This illustrates the use of three formulations a, b and c containing different proportions of colour developing composite to extender (kaolin).

The procedure employed was generally as described in Example 1, except that the quantities of material used were as follows:

| Material | (a) | (b) | (c) |
|---|---|---|---|
| De-ionised water | 207.5 | 207.5 | 207.5 |
| CMC | 2.4 | 2.4 | 2.4 |
| $Al_2(SO_4)_3.16H_2O$ | 14.6 | 10.2 | 6.0 |
| Silica (Gasil 35) | 70.0 | 50.0 | 29.5 |
| kaolin (Dinkie A) | 20.0 | 40.6 | 61.8 |
| latex (Dow 620) | 20.2 | 20.2 | 20.2 |

The content of hydrated silica/hydrated alumina, on a dried weight basis, in the above formulations was as follows:

| | |
|---|---|
| a | 78% |
| b | 56% |
| c | 33% |

The results obtained for calender intensity and fade tests with Papers A and B were as follows:

| Test Conditions | % $SiO_2/Al_2O_3$ Intensity ($I/I_0$) Paper A 78% | 56% | 33% | Paper B 78% | 56% | 33% |
|---|---|---|---|---|---|---|
| 2 min. development | 44.7 | 48.6 | 51.7 | 44.3 | 46.8 | 48.4 |
| 48 hour development | 33.2 | 38.9 | 43.1 | 34.9 | 40.2 | 42.6 |
| 1 hour fade | 33.5 | 38.3 | 43.0 | 33.6 | 38.3 | 41.4 |
| 3 hour fade | 39.5 | 40.9 | 45.7 | 35.1 | 40.2 | 43.7 |
| 5 hour fade | 40.7 | 42.6 | 47.0 | 38.0 | 42.4 | 46.3 |
| 10 hour fade | 44.4 | 46.9 | 53.8 | 44.9 | 47.2 | 52.4 |
| 15 hour fade | 50.6 | 51.7 | 59.9 | 54.5 | 52.3 | 58.4 |
| 30 hour fade | 61.4 | 61.8 | 68.3 | 71.8 | 63.5 | 67.6 |
| 50 hour fade | 67.6 | 67.3 | 72.9 | — | 70.1 | 79.5 |
| 100 hour fade | 76.3 | 74.4 | 78.1 | — | 73.6 | 83.0 |

EXAMPLE 13

This illustrates the use of a particulate material in a process in which both the silica and the alumina are precipitated. The particulate material may act as a nucleating agent.

2.4 g of CMC was dissolved in 140 g de-ionized water over a period of 15 minutes with stirring. 94 g of 48% sodium silicate solution (Pyramid 120) were added and the mixture stirred for 5 minutes. 22 g of kaolin (Dinkie A) were then added followed by stirring for a further 5 minutes. 25 g of aluminium sulphate, $Al_2(SO_4)_3.16H_2O$, 40% w/w were then added and the mixture was stirred for 15 minutes. 38 g of 20% w/w solution of copper sulphate $CuSO_4.5H_2O$ were then added, with stirring for 5 minutes. 40 g of 40% w/w sulphuric acid were then added drop-wise as described in Example 8. Finally 20 g of latex (Dow 675) were added, and the mixture was left overnight. The next morning it was coated and tested as described in previous examples using Papers A and C.

For Paper A, the 2 min. development value of $I/I_0$ was 39.4, the 48 hour development value was 33.1 and the 16 hour fade value was 47.0. For Paper C, the corresponding values were 47.7, 40.6 and 49.2.

It has been found that better colour developing properties are achieved if the mix is left overnight before being coated than if it is coated immediately after preparation.

EXAMPLE 14

This illustrates the use of sodium aluminate as the material from which hydrated alumina is deposited.

2.4 g of CMC (FF5) was dissolved in 210 g of de-ionised water over a period of 15 minutes with stirring. 45.0 g of silica (Gasil 35) was added followed by 2.0 g of sodium aluminate (in solid form). The mixture was stirred for about an hour. 36.0 g of kaolin were then added, and stirring was continued for a further half-hour. 20.0 g of latex (Dow 620) were then added, after which the pH was adjusted to 7 with sulphuric acid. The mixture was then coated on to paper and tested using Paper A as described in previous Examples.

The 2 min. colour development value was 44.2, the 48 hour development value was 35.7 and the 16 hour fade value was 46.2.

EXAMPLE 15

This illustrates the use of sodium hexametaphosphate as the dispeersant instead of CMC.

4 g of sodium hexamethaphosphate was dissolved in 1605 g water over a period of 15 minutes with stirring. 450 g of silica (Gasil 35) was added and stirring was continued for 15 minutes. 340 g of 25% w/w solution of aluminium sulphate, $Al_2(SO_4)_3$. $16H_2O$ were then added, and the mixture was stirred for two hours. 365 g of kaolin (Dinkie A) were then added and stirring was continued for a further 15 minutes. 320 g of 25% w/w solution of copper sulphate were then aadded and stirring was continued for a further hour. 200 g of latex (Dow 675) were then added. The pH of the mixture was then adjusted to 7 using sodium hydroxide solution.

The mixture was then coated on to paper using a Dixon pilot plant roll coater (after dilution of the mix to afford an appropriate viscosity for coating) and the coated paper was dried, calendered and subjected to calender intensity and fade resistance tests (using Paper A). The results were as follows:

| Test Conditions | Intensity ($^I/_{I_0}$) |
|---|---|
| 2 min. development | 40.3 |
| 48 hour development | 35.3 |
| 1 hour fade | 35.5 |
| 3 hour fade | 36.4 |
| 5 hour fade | 38.1 |
| 10 hour fade | 42.4 |
| 15 hour fade | 45.4 |
| 30 hour fade | 54.1 |
| 50 hour fade | 61.6 |
| 100 hour fade | 66.6 |

EXAMPLE 16

This illustrates the modification of a hydrated silica/-hydrated alumina composite with two metal compounds or ions.

1.2 g of CMC (FF5) was dissolved in 105 g de-ionized water with stirring over a period of 15 minutes. 22.5 g of silica (Gasil 35) were added followed by 18 g of 25% w/w solution of aluminum sulphate, $Al_2(SO_4)_3$. $16H_2O$. The mixture was left stirring for more than an hour. 4.5 g of nickel sulphate, $NiSO_4$ $6H_2O$ and 5.0 g of cobalt sulphate, $CoSO_4$, $7H_2O$ were added and allowed to dissolve. Stirring was continued for a further hour. 16 g of kaolin (Dinkie A) were then added and the pH was adjusted to 7.0 by the addition of sodium hydroxide, after which 20.0 g of latex (Dow 675) was added. The pH was then re-adjusted to 7.0, and the mixture was coated using a laboratory Meyer bar coater as described in earlier examples. The resulting paper was tested for calender intensity as described earlier, using Papers A and C.

The results for Paper A were 40.5 and 33.0 for 2 min. and 48 hour development respectively, and the Paper C were 46.8 and 41.0 for 2 min. and 48 hour development respectively.

EXAMPLE 17

This illustrates modification using copper and nickel as the modifying compounds in place of the cobalt and nickel modification described in the previous Example.

The procedure was as described in Example 16 except that 4.5 g of copper sulphate, $CuSO_4$. $5H_2O$ and 5.0 g of nickel sulphate, $NiSO_4$. $6H_2O$ were used.

The results for Paper A were 40.8 and 32.8 for 2 min. and 48 hour development respectively and for Paper B were 47.5 and 41.1 for 2 min. and 48 hour development respectively.

EXAMPLE 18

This illustrates the use on a colour developer composition of a hydrated silica/hydrated alumina composite in combination with another colour developing material, namely an acid-washed dioctahedral montmorillonite clay.

32.0 Kg of 10% CMC solution (FF5) were dispersed with agitation in 109.8 Kg of water, and 123.3 Kg of 48% solids content sodium silicate solution (Pyramid 120) were added. Agitation was maintained to bring about dispersion of the sodium silicate. 21.5 Kg of 40% aluminium sulphate ($Al_2$ $(SO_4)_3$.$16H_2O$) solution were then added, followed by 25.0 Kg of 40% sulphuric acid, whilst maintaining vigorous agitation throughout. After this addition was complete, further 40% sulphuric acid was added slowly, until thickening occurred, still with vigorous agitation, which was then continued without further acid addition for 15 minutes. Whilst still maintaining vigorous agitation, further 40% sulphuric acid was added slowly until pH 10.5 was reached, followed by quick addition of more 40% sulphuric acid to pH 8.2. The total amount of 40% sulphuric acid added was approximately 50.0 Kg.

The amounts of sodium silicate and aluminium sulphate used were such that hydrated alumina constituted 3.5% of the total precipitated hydrated silica/hydrated alumina mixture (on a dry weight basis).

The resulting suspension was passed through a continuous flow ball mill at a rate such as to achieve a mean volume particle size of 3.0 to 3.5 μm (measured by means of a Coulter Counter, 50 μm tube).

After ball-milling, the suspension was agitated vigorously for a further 10 minutes. 71.8 Kg of acid-washed dioctahedral montmorillonite clay ("Silton" clay supplied by Mizusawa Chemical Industries of Japan) were then added with vigorous agitation, which was continued for a further 30 minutes after the clay addition was complete. Latex binder (Dow 675) was then added, and the pH was adjusted to 7.7. The mixture was then coated on to paper using a trailing blade coater.

The resulting papers were then tested with Paper A and the results were as follows:

| Test Conditions | Intensity ($^I/_{I_0}$) |
|---|---|
| 2 min development | 44 |
| 48 hour development | 38 |
| 1 hour fade | 40 |
| 3 hour fade | 46 |
| 5 hour fade | 53 |
| 10 hour fade | 56 |
| 15 hour fade | 61 |
| 30 hour fade | 66 |
| 50 hour fade | 68 |

EXAMPLE 19

This illustrates the production of a hydrated silica/-hydrated alumina composite by a method in which hydrated silica and hydrated alumina are precipitated sequentially in one operation. By way of comparison, a process is also described in which the same materials are used to precipitate the hydrated silica and hydrated alumina simultaneously.

190 g of 40% w/w sulphuric acid solution was added slowly with stirring to 300 g of 48% w/w sodium silicate solution, with the result that the pH of the sodium silicate solution dropped from around 13 to a neutral value (7.0). This resulted in precipitation of hydrated silica. The suspended precipitate was then ball-milled to break up any agrregates. 62 g of 40% w/w solution of aluminium sulphate, $Al_2(SO_4)_3.16H_2O$, was then added slowly with stirring. The resulting pH was about 3.5. 40 g of 30% w/w sodium hydroxide solution was then added slowly with stirring until the pH was neutral (7.0). Hydrated alumina was precipitated on to the previously precipitated hydrated silica. Sufficient water was then added to lower the viscosity to a value suitable for coating by means of a laboratory Meyer bar coater. The mixture was then coated on to paper at a nominal coat weight of 8 $gm^{-2}$ and the coated sheet was then dried and calendered.

By way of comparison, 62 g of 40% w/w solution of, aluminum sulphate, $Al_2(SO_4)_3.16H_2O$, was added slowly to 300 g of 48% w/w solution of sodium silicate. The pH of the mixture was then lowered slowly by the addition of 40% w/w sulphuric acid until a neutral pH (7.0) was reached. Simultaneous precipitation of hydrated silica and hydrated alumina started to occur at around pH 10.5 and was complete at about pH 9.0. The suspension of precipitate was then ball-milled. The mixture was then diluted, coated, dried and calendered as described above.

The alumina level in the composites prepared as described above was 4.0% on a dried weight basis, based on the total weight of silica and alumina. Calender intensity and fade resistance tests were then carried out on both papers (using Paper D - see Example 7) and the results were as follows:

| Test Condition | Intensity ($I/I_0$) Sequential Precipitation | Simultaneous Precipitation |
|---|---|---|
| 2 min development | 66.0 | 68.3 |
| 24 hour development | 60.4 | 63.0 |
| 1 hour fade | 63.5 | 71.1 |
| 3 hour fade | 64.5 | 82.8 |
| 5 hour fade | 66.5 | 89.4 |
| 10 hour fade | 75.1 | 94.6 |
| 15 hour fade | 78.2 | 96.2 |
| 30 hour fade | 88.9 | 98.8 |

It will be seen that the sequential precipitation procedure affords improved results compared with the simultaneous precipitation procedure.

Although the simultaneous precipitation procedure is referred to above as being by way of comparison, it should be appreciated that it nevertheless exemplies the invention.

EXAMPLE 20

This demonstrates that the presence of kaolin is not essential in obtaining good colour developing properties.

1.2 g of CMC were dissolved in 197 g of de-ionized water over a period of 15 minutes with stirring. 45 g of silica (Gasil 35) were added, followed by 21.5 g of 40% w/w solution of aluminium sulphate, $Al_2(SO_4)_3.16H_2O$. The mixture was left stirring for an hour and 32.0 g of 25% w/w solution of copper sulphate, $CuSO_4.5H_2O$ were added. Stirring was continued for a further hour, after which 20% of styrene-butadiene latex (Dow 675) were added. The pH was then raised to 7.0 with sodium hydroxide. Sufficient water was added to lower the viscosity to a value suitable for coating using a laboratory Meyer bar coater. The mixture was then coated on to paper at a nominal coat weight of 9 $gm^{-2}$ and the coated sheet was then dried and calendered.

By way of comparison, the procedure was then repeated except that 36.5 g of kaolin were dispersed in the mixture before the coating step.

Calender intensity and fade resistance tests were then carried out on both papers, using Papers A and C described earlier, and the results were as follows:

| Test Conditions | Intensity ($I/I_0$) Paper A No kaolin | Paper A kaolin present | Paper C No kaolin | Paper C kaolin present |
|---|---|---|---|---|
| 2 min. development | 50.6 | 50.0 | 51.3 | 52.6 |
| 48 hour development | 36.7 | 37.1 | 41.5 | 42.9 |
| 16 hour development | 41.7 | 42.5 | 43.1 | 45.2 |

It will be seen that comparable results are obtained whether or not kaolin is present, from which it can be concluded that the presence of kaolin is not essential to the achievement of the benefits of the invention.

EXAMPLE 21

This illustrates the use of a further commercially available brand of silica gel, namely Syloid 72, supplied by Grace, and compares the results obtained using the silica gel alone with those obtained using the silica gel modified by the inclusion of hydrated alumina to give a hydrated silica hydrated alumina composite containing 2.7% alumina, on a dried weight basis based on the total weight of silica and alumina.

1.2 g of CMC were dissolved in 182 g de-ionized water over a period of 15 minutes with stirring. 34 g of silica gel (Syloid 72) were added followed by 14 g of 40% w/w solution of aluminium sulphate, $Al_2(SO_4)_3$, $16H_2O$.

The mixture was left stirring for an hour and 10 g kaolin were added, after which stirring was continued for a further hour. 10.1 g of styrene-butadiene latex were added, and the pH was raised to 7.0 with sodium hydroxide solution. Sufficient water was added to lower the viscosity to a value suitable for coating using a laboratory Meyer bar coater. The mixture was then coated on to paper at a nominal coat weight of 8 $gm^{-2}$, and the coated paper was dried and calendered.

By way of comparison, the procedure was repeated except that no aluminium sulphate solution was added.

Calender intensity and fade resistance tests were then carried out on both papers, using Papers A, C and D described earlier, and the results were as follows:

| Test Conditions | Intensity ($I/I_0$) Paper A alumina | Paper A no alumina | Paper C alumina | Paper C no alumina | Paper D alumina | Paper D no alumina |
|---|---|---|---|---|---|---|
| 2 min development | 43.1 | 45.8 | 47.8 | 48.5 | 59.0 | 63.4 |
| 48 hour development | 33.6 | 37.8 | 42.0 | 41.6 | 54.1 | 56.0 |
| 5 hour fade | 35.4 | 46.2 | 42.5 | 48.0 | 61.7 | 81.0 |

It will be seen that the presence of the alumina markedly improved fade resistance, and also produced a slight improvement in initial intensity.

EXAMPLE 22

This illustrates a number of variations of a process in which both hydrated silica and hydrated alumina are precipitated.

Variation 1

4.8 g of CMC (FF5) were dissolved in 280.0 g de-ionized water over 15 minutes with stirring, and 188.0 g of 48% w/w solution of sodium silicate (Pyramid 120) were added, with continued stirring. When the sodium silicate had been dispersed, 40% w/w sulphuric acid was added dropwise over a period of at least half an hour until pH 7.0 was reached, taking the precautions described in Example 8. 50.0 g of a 40% w/w solution of aluminium sulphate, $Al_2(SO_4)_3.16H_2O$ were then added, and the mixture was stirred for 15 minutes. 96.0 g of a 20% w/w solution of copper sulphate, $CuSo_4.5H_2O$ were added, and the mixture was stirred for 5 minutes.

511 g of the suspension resulting from the above was weighed out, and 44 g of kaolin were added, and the mixture was stirred for 30 minutes. 40 g of styrenebutadiene latex (Dow 675) were then added, and the pH was re-adjusted to 7.0. The mixture was then diluted with sufficient water to make it suitable for coating by means of a Meyer bar laboratory coater, and coated on to paper at a nominal coat weight of 8 $gm^{-2}$. The coated sheet was then dried and calendered and subjected to calender intensity and fade resistance tests with Paper A.

Variation 2

The procedure of Variation 1 was repeated except that the sulphuric acid was added before, rather than after, the sodium silicate.

Variation 3

The procedure of Variation 1 was repeated except that the sulphuric acid and the sodium silicate solution were added simultaneously to the CMC solution.

Variation 4

The procedure of Variation 1 was repeated except that the aluminium sulphate and sodium silicate solutions were added simultaneously to the CMC solution.

Variation 5

The procedure of Variation 2 was repeated except that the aluminium sulphate and sodium silicate solutions were added simultaneously to the CMC/sulphuric acid solution.

Variation 6

The procedure of Variation 1 was repeated except that the aluminium sulphate, sulphuric acid and sodium silicate solutions were added simultaneously to the CMC solution.

The results were as follows:

| Test | Variation No. Intensity ($^I/_{I_0}$) | | | | | |
|---|---|---|---|---|---|---|
| Conditions | 1 | 2 | 3 | 4 | 5 | 6 |
| 2 min development | 61.6 | 80.6 | 75.2 | 48.2 | 57.2 | 84.7 |

-continued

| Test | Variation No. Intensity ($^I/_{I_0}$) | | | | | |
|---|---|---|---|---|---|---|
| Conditions | 1 | 2 | 3 | 4 | 5 | 6 |
| 48 hour development | 58.1 | 69.3 | 59.0 | 42.9 | 49.5 | 74.6 |
| 100 hour fade | 82.9 | 88.8 | 81.7 | 77.0 | 81.9 | 89.0 |

EXAMPLE 23

This illustrates the effect of ball milling the hydrated silica/hydrated alumina composite.

The procedures of each of Variations 1 to 3, and 4 and 5 of Example 22 were repeated, except that each suspension prepared was ball milled for half an hour prior to the addition of kaolin and latex.

The results were as follows:

| Test | Variation No. Intensity ($^I/_{I_0}$) | | | | | |
|---|---|---|---|---|---|---|
| Conditions | 1 | 2 | 3 | 4 | 5 | 6 |
| 2 min. development | 46.7 | 45.0 | 55.0 | — | 45.0 | 50.5 |
| 48 hour development | 41.3 | 42.8 | 49.0 | — | 39.8 | 44.9 |
| 100 hour fade | 76.8 | 79.0 | 77.5 | — | 76.3 | 77.7 |

It will be seen that strikingly improved properties are obtained.

EXAMPLE 24

This illustrates the effect of copper modification at a range of different copper concentrations.

1.2 g of CMC were dissolved in 197 g de-ionized water over a period of 15 minutes with stirring. 45 g of silica (Gasil 35) were added, followed by 21.5 g of a 40% w/w solution of aluminium sulphate, $Al_2(SO_4)_3$, $1CH_2O$. and the mixture was left stirring for an hour. Xg of powdered copper sulphate, $CuSo_4$, $5H_2O$, was then added and stirring was continued until it was fully dispersed and dissolved. 36.5 g of kaolin were then added, and the mixture was stirred for half an hour, after which 20.0 g of latex (Dow 675) were added. The pH was then raised to 7.0 with sodium hydroxide solution. Sufficient water was added to lower the viscosity of the mixture to a value suitable for coating using a labroatory Meyer bar coater, and the mixture was then coated on to paper at a nominal coat weight of 8 $gm^{-2}$. The coated sheet was dried and calendered and subjected to calender intensity and fade resistance tests using Papers A and B.

The value of x was 0, 0.14, 0.73, 1.47, 2.96, 6.04 and 12.61, so that the % of copper in the hydrated silica/hydrated alumina composite, calculated on a dry weight basis as cupric oxide to total weight of silica, alumina and cupric oxide was 0, 0.1, 0.5, 1.0, 2.0, 4.0, and 8.0%.

The results were as follows:

| Test | Paper A % Cu O Intensity ($^I/_{I_0}$) | | | | | | |
|---|---|---|---|---|---|---|---|
| Conditions | 0 | 0.1 | 0.5 | 1.0 | 2.0 | 4.0 | 8.0 |
| 2 min. development | 50.0 | 50.8 | 52.6 | 53.7 | 49.5 | 49.5 | 49.1 |
| 48 hour development | 37.0 | 40.0 | 41.3 | 43.3 | 39.2 | 39.3 | 38.6 |
| 16 hour fade | 42.5 | 41.7 | 43.1 | 43.3 | 40.0 | 41.7 | 43.0 |

| Test Conditions | Paper D % Cu O Intensity ($I/I_o$) 0 | 0.1 | 0.5 | 1.0 | 2.0 | 4.0 | 8.0 |
|---|---|---|---|---|---|---|---|
| 2 min. development | 65.1 | 66.3 | 66.1 | 67.4 | 64.7 | 63.0 | 62.6 |
| 48 hour development | 57.8 | 58.5 | 59.4 | 64.8 | 57.8 | 57.0 | 57.1 |
| 16 hour fade | 72.0 | 66.4 | 69.0 | 68.1 | 62.6 | 62.2 | 62.8 |

It will be seen that even a 0.1% addition improved fade resistance significantly for both Papers A and D. The optimum addition level is in the range 2.0 to 4.0%.

EXAMPLE 25

The procedure of Example 24 was repeated except that 0.16, 1.66, 6.84 and 14.28 g of zinc sulphate $ZnSO_4$, $7H_2O$ were used instead of the copper sulphate additions of Example 24. The resulting modification levels, calculated as zinc oxide rather than cupric oxide, were 0.1, 1.0, 4.0 and 8.0%.

The results were as follows:

| Test Conditions | Paper A % Zn O Intenstiy ($I/I_o$) 0 | 0.1 | 1.0 | 4.0 | 8.0 |
|---|---|---|---|---|---|
| 2 min development | 50.0 | 50.2 | 51.5 | 47.4 | 45.5 |
| 48 hour development | 37.1 | 38.5 | 40.4 | 37.2 | 37.3 |
| 16 hour fade | 42.5 | 44.6 | 46.7 | 43.8 | 43.6 |

| Test Conditions | Paper D % Zn O Intensity ($I/I_o$) 0 | 0.1 | 1.0 | 4.0 | 8.0 |
|---|---|---|---|---|---|
| 2 min development | 65.1 | 66.7 | 67.5 | 63.9 | 62.0 |
| 48 hour development | 57.8 | 60.4 | 59.3 | 58.0 | 56.9 |
| 16 hour fade | 72.0 | 72.6 | 71.0 | 68.2 | 67.8 |

The presence of zinc improves at high modification levels, improves initial intensity and improves fade resistance with CVL Paper D), also at high modification levels.

EXAMPLE 26

The procedure of Example 24 was repeated except that 0.15, 0.74, 1.50, 3.03, 6.19 and 12.9 g of nickel chloride, $NiCl_2.6H_2O$ were used instead of the copper sulphate additions of Example 24. The resulting modification levels calculated as nickel oxide, were the same.

The results were as follows:

| Test Conditions | Paper A % Ni O Intensity ($I/I_o$) 0 | 0.1 | 0.5 | 1.0 | 2.0 | 4.0 | 8.0 |
|---|---|---|---|---|---|---|---|
| 2 min. development | 50.0 | 50.5 | 51.9 | 48.0 | 47.4 | 47.7 | 47.0 |
| 48 hour development | 37.1 | 39.4 | 40.7 | 38.3 | 37.1 | 37.1 | 37.5 |
| 16 hour fade | 42.5 | 45.4 | 46.1 | 42.3 | 41.2 | 40.2 | 43.1 |

| Test Conditions | Paper D % Ni O Intensity ($I/I_o$) 0 | 0.1 | 0.5 | 01.0 | 2.0 | 4.0 | 8.0 |
|---|---|---|---|---|---|---|---|
| 2 min. development | 65.1 | 67.0 | 67.2 | 63.4 | 62.6 | 64.3 | 66.9 |
| 48 hour development | 57.8 | 59.6 | 60.9 | 59.5 | 58.0 | 57.0 | 60.1 |
| 16 hour fade | 72.0 | 71.7 | 71.5 | 68.1 | 66.0 | 65.0 | 69.8 |

The presence of nickel improves initial intensity at 1% addition levels and above.

EXAMPLE 27

The procedure of Example 24 was repeated except that 0.11, 0.56, 1.14, 2.30, 4.70 and 9.80 g of anhydrous calcium sulphate were used instead of the copper sulphate additions of Example 24. The resulting modification levels, calculated as calcium oxide, were the same.

The results were as follows:

| Test Conditions | Paper A % Ca O Intensity ($I/I_o$) 0 | 0.1 | 0.5 | 1.0 | 2.0 | 4.0 | 8.0 |
|---|---|---|---|---|---|---|---|
| 2 min development | 50.0 | 45.9 | 47.1 | 46.4 | 48.6 | 49.6 | 48.4 |
| 48 hour development | 37.1 | 35.2 | 36.9 | 36.1 | 39.4 | 39.8 | 38.2 |
| 16 hour fade | 42.5 | 43.5 | 43.9 | 43.5 | 47.4 | 47.4 | 46.0 |

| Test Conditions | Paper D % Ca O Intensity ($I/I_o$) 0 | 0.1 | 0.5 | 1.0 | 2.0 | 4.0 | 8.0 |
|---|---|---|---|---|---|---|---|
| 2 min development | 65.1 | 60.0 | 61.7 | 60.6 | 64.3 | 65.0 | 64.3 |
| 48 hour development | 57.8 | 53.7 | 54.3 | 54.3 | 59.0 | 59.8 | 58.4 |
| 16 hour fade | 72.0 | 66.6 | 68.2 | 68.0 | 72.7 | 71.6 | 71.5 |

The presence of calcium improves initial intensity and 48 hour development at certain level of addition, and has a beneficial effect on fade resistance in relation to CVL (Paper D) at low levels of addition.

EXAMPLE 28

The procedure of Example 24 was repeated except that 0.28, 1.43, 2.88, 5.82, 11.90 and 24.8 g of magnesium sulphate, Mg $SO_4$, $7H_2O$ were used instead of the copper sulphate additions of Example 24. The resulting modification levels, calculated as magnesium oxide, were the same.

The results were as follows:

| Test Conditions | Paper A % Mg O Intensity ($I/I_o$) 0 | 0.1 | 0.5 | 1.0 | 2.0 | 4.0 |
|---|---|---|---|---|---|---|
| 2 min development | 50.0 | 48.5 | 48.1 | 48.5 | 46.4 | 46.3 |
| 48 hour development | 37.1 | 38.5 | 38.4 | 38.5 | 38.0 | 38.0 |
| 16 hour fade | 42.5 | 46.5 | 47.2 | 45.7 | 45.9 | 45.8 |

| Test Conditions | Paper D % Mg O Intensity ($I/I_o$) 0 | 0.1 | 0.5 | 1.0 | 2.0 | 4.0 |
|---|---|---|---|---|---|---|
| 2 min. development | 65.1 | 64.6 | 64.7 | 63.9 | 63.7 | 62.0 |
| 48 hour development | 57.8 | 58.7 | 58.8 | 57.5 | 57.9 | 57.0 |
| 16 hour fade | 72.0 | 74.5 | 74.1 | 72.2 | 72.7 | 73.1 |

The presence of magnesium improves initial intensity at all levels of addition.

EXAMPLE 29

The procedure of Example 24 was repeated except that 0.08, 0.39, 0.79, 1.60, 3.27, and 6.82 g of cobalt sulphate $CoSO_4.7H_2O$ were used instead of the copper sulphate additions of Example 24. The resulting modification levels, calculated as cobalt oxide, were the same.

The results were as follows:

| Test conditions | Paper A % $Co_2O_3$ Intensity ($I/I_o$) 0 | 0.1 | 0.5 | 1.0 | 2.0 | 4.0 | 8.0 |
|---|---|---|---|---|---|---|---|
| 2 min development | 50.0 | 47.3 | 47.4 | 47.7 | 48.7 | 48.3 | 47.3 |
| 48 hour development | 37.1 | 36.0 | 36.8 | 36.4 | 37.5 | 36.9 | 37.0 |
| 16 hour fade | 42.5 | 45.0 | 43.5 | 44.1 | 43.0 | 42.9 | 45.4 |

| Test conditions | Paper D % $Co_2O_3$ Intensity ($I/I_o$) 0 | 0.1 | 0.5 | 1.0 | 2.0 | 4.0 | 8.0 |
|---|---|---|---|---|---|---|---|
| 2 min development | 65.1 | 63.2 | 64.5 | 64.7 | 64.1 | 63.0 | 62.6 |
| 48 hour development | 57.8 | 56.6 | 57.3 | 57.1 | 57.9 | 57.4 | 58.8 |
| 16 hour fade | 72.0 | 71.6 | 69.5 | 71.0 | 67.1 | 69.5 | 69.7 |

The presence of cobalt improves initial intensity at all levels of addition.

EXAMPLE 30

This demonstrates that CMC or another polymeric material need not be present during the production of the hydrated silica/hydrated alumina composite.

94 g of 48% $^w/_w$ sodium silicate solution were dispersed with stirring in 140 g de-ionized water, 25 g of 25% $^w/_w$ solution of aluminum sulphate, $Al_2(SO_4)_3.16H_2O$ were added and the mixture was stirred for 15 minutes. 56 g of 25% $^w/_w$ solution of copper sulphate, $CuSO_4.5H_2O$ were added and stirring was continued for a further 10 minutes. Sulphuric acid was then added over a period of about ½ hour, observing the procedure described in previous examples, so as to give a pH of 7.0, 20 g of kaolin were then added, and the resulting dispersion was ball-milled overnight. 20 g of styrene-butadiene latex were then added and the pH was re-adjusted to 7.0 (if necessary). The resultant mixture was diluted with sufficient water to make it suitable for coating by means of a Meyer bar laboratory coater, and coated on to paper at a nominal coat weight of 8 $gm^{-2}$. The coated sheet was then dried and calendered and subjected to calender intensity and fade resistance tests. The two minute development value of ($I/I_o$) was 46, the 48 hour development value was 38, and the value after 15 hours fading was 55. These values are comparable to those obtained in other Examples, from which it can be concluded that the presence of a polymeric material is not essential to the production of an effective colour developing composite. The tests were done with Paper A.

EXAMPLE 31

This demonstrates the suitability of the composite for use in heat-sensitive record material.

97 g of silica (Gasil 35) was dispersed in 750 g of de-ionized water with stirring and 46.4 g of 40% $^w/_w$ solution of aluminum sulphate, $Al_2(SO_4)_3.16H_2O$ was added. The pH was adjusted to 7 and the mixture was stirred for an hour after which 38.9 g of 25% $^w/_w$ solution of copper sulphate was added. The pH was then re-adjusted to 7 and stirring was continued for a further two hours. The suspended solid material was then filtered off, washed thoroughly with de-ionized water, and dried in a fluid-bed dryer.

20 g of the composite were mixed with 48 g of stearamide wax and ground in a pestle and mortar. 45 g of de-ionized water and 60 g of 10% $^w/_w$ poly(vinyl alcohol) solution (Gohsenol GL05) were added and the mixture was ball-milled overnight. A further 95 g of 10% $^w/_w$ poly(vinyl alcohol) solution were then added, together with 32 g de-ionized water.

In a separate procedure, 22 g of a black colour former (2'-anilino-6'-diethylamino-3'-methylfluoran), were mixed with 42 g de-ionized water and 100 g of 10% $^w/_w$ poly(vinyl alcohol) solution, and the mixture was ball-milled overnight.

The suspensions resulting from the above procedures were then mixed and coated on to paper by means of a laboratory Meyer bar coater at a nominal coat weight of 8 $gm^{-2}$. The paper was then dried.

On subjecting the coated surface to heat, a black coloration was obtained.

I claim:

1. A process for the production of record material carrying a particulate amorphous hydrated silica/hydrated alumina composite comprising:

(a) reacting hydrated silica and hydrated alumina in an aqueous medium thereby yielding an amorphous hydrated silica/hydrated alumina composite having a mean alumina content of from 1.5 to 5.0% based on the total dry weight of silica and alumina;

(b) applying a coating composition incorporating said composite to a substrate; and (c) drying the coated substrate to produce record material.

2. The process of claim 1 wherein the hydrated alumina is reacted with the hydrated silica by precipitation of the hydrated alumina from the aqueous medium in the presence of dispersed previously-precipitated hydrated silica, with resultant deposition of the hydrated alumina on to the hydrated silica to form said composite.

3. The process of claim 1 or 2 wherein the hydrated silica and hydrated alumina are reacted together in the presence of a polymeric rheology modifier.

4. The process of claim 3 wherein the rheology modifier is carboxymethyl cellulose.

5. The process of claim 1 wherein the hydrated silica and hydrated alumina are precipitated together in the presence of a particulate material.

6. The process of claim 5 wherein the particulate material is kaolin.

7. The process of claim 1 wherein after reaction of the hydrated silica and hydrated alumina to form the composite, the reaction mixture is ball milled until the mean volume particle size of the composite is about 3.0 to 3.5 μm.

8. The process of claim 1 or 2 wherein a modifying metal compound is present during the reaction of the hydrated alumina with the hydrated silica, or is introduced as a sequential step after that reaction, with resultant metal modification of the hydrated silica/hydrated alumina composite.

9. The process of claim 1 or 2 wherein the surface area of the hydrated silica/hydrated alumina composite is less than 300 $m^2g^{-1}$.

10. Record material produced by the process of claim 1 or 2.

* * * * *